US007647789B2

(12) United States Patent
Aung et al.

(10) Patent No.: US 7,647,789 B2
(45) Date of Patent: Jan. 19, 2010

(54) EVAPORATOR UNIT AND EJECTOR TYPE REFRIGERATION CYCLE

(75) Inventors: Thuya Aung, Kariya (JP); Yoshiyuki Okamoto, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/653,622

(22) Filed: Jan. 15, 2007

(65) Prior Publication Data

US 2007/0163294 A1 Jul. 19, 2007

(30) Foreign Application Priority Data

Jan. 19, 2006 (JP) ..... 2006-011017

(51) Int. Cl.
*F25B 1/06* (2006.01)

(52) U.S. Cl. ..... 62/500; 62/515

(58) Field of Classification Search ..... 62/87, 62/498, 500, 515, 524
See application file for complete search history.

(56) References Cited

U.S. PATENT DOCUMENTS

| | | | | |
|---|---|---|---|---|
| 3,705,622 | A | 12/1972 | Schwarz | |
| 6,065,573 | A | 5/2000 | Kelly | |
| 6,260,379 | B1 | 7/2001 | Manwill et al. | |
| 6,574,987 | B2 | 6/2003 | Takeuchi et al. | |
| 6,925,835 | B2 * | 8/2005 | Nishijima et al. | 62/500 |
| 6,941,768 | B2 * | 9/2005 | Ikegami et al. | 62/500 |
| 2004/0159121 | A1 | 8/2004 | Horiuchi et al. | |
| 2005/0039895 | A1 | 2/2005 | Inaba et al. | |
| 2005/0178150 | A1 | 8/2005 | Oshitani et al. | |
| 2005/0268644 | A1 | 12/2005 | Oshitani et al. | |
| 2007/0169510 | A1 | 7/2007 | Ishizaka et al. | |
| 2007/0169511 | A1 | 7/2007 | Ishizaka et al. | |

FOREIGN PATENT DOCUMENTS

| | | |
|---|---|---|
| JP | 06-137695 | 5/1994 |
| WO | WO 2006/109617 | 10/2006 |

OTHER PUBLICATIONS

Office action dated Sep. 23, 2008 in German Application No. 10 2007002549.3 with English translation thereof.
Office action dated Jan. 26, 2009 in corresponding U.S. Appl. No. 11/654,206.
Office action dated Aug. 11, 2009 in corresponding U.S. Application No. 2007/0169510.
Office action dated Aug. 31, 2009 in corresponding U.S. Application No. 2007-0169511.

* cited by examiner

*Primary Examiner*—Melvin Jones
(74) *Attorney, Agent, or Firm*—Harness, Dickey & Pierce, PLC

(57) ABSTRACT

An evaporator unit includes an ejector, an upwind side heat exchanger for evaporating a discharge side refrigerant flowing from the ejector, and a downwind side heat exchanger for evaporating a suction side refrigerant to be drawn into the ejector. The ejector has a nozzle for decompressing refrigerant, and a refrigerant suction port, from which refrigerant is drawn by a high-speed flow of refrigerant jetted from the nozzle. The upwind side heat exchanger has a refrigerant superheat area, which is offset from a refrigerant superheat area of the downwind side heat exchanger in a direction perpendicular to an air flow to be cooled.

20 Claims, 6 Drawing Sheets

EVAPORATOR UNIT AND EJECTOR TYPE REFRIGERATION CYCLE

CROSS REFERENCE TO RELATED APPLICATION

This application is based on Japanese Patent Application No. 2006-11017 filed on Jan. 19, 2006, the disclosure of which is incorporated herein by reference in its entirety.

BACKGROUND OF THE INVENTION

1. Field of the Invention

The present invention relates to an evaporator unit having a plurality of heat exchangers, and an ejector type refrigeration cycle, in which the evaporator unit is used.

2. Description of Related Art

U.S. 2005/0268644 A1 (corresponding to JP-A-2005-308384) discloses an ejector type refrigeration cycle, in which air is cooled by an upwind side heat exchanger located at the upwind side of an air flow, and the air cooled by the upwind side heat exchanger is further cooled by a downwind side heat exchanger located at the downwind side of the air flow.

The upwind side heat exchanger is connected to a diffuser of an ejector, and the downwind side heat exchanger is connected to a refrigerant suction port of the ejector. A refrigerant evaporation temperature in the upwind side heat exchanger is made higher than a refrigerant evaporation temperature in the downwind side heat exchanger by a pressure-increasing operation of the diffuser. Thereby, a difference between an air temperature and a refrigerant evaporation temperature can be secured in each of the upwind side heat exchanger and the downwind side heat exchanger. Thus, the air can be effectively cooled.

WO 2006/109617 proposes an ejector type refrigeration cycle device, in which an upwind side heat exchanger, a downwind side heat exchanger and an ejector are integrated. The ejector is located inside of a header tank in the downwind side heat exchanger.

Because the ejector is integrally formed inside of the downwind side heat exchanger, the downwind side heat exchanger and the ejector can be easily and accurately mounted to the device. Further, because a refrigerant suction port of the ejector is directly open to a refrigerant gathering part of the header tank, pressure loss can be reduced when refrigerant is drawn into the ejector through the suction port from the downwind side heat exchanger.

However, when the device is actuated, temperature distribution for air flowing out of the downwind side heat exchanger may not be uniform. This is because a refrigerant superheat area of the upwind side heat exchanger and a refrigerant superheat area of the downwind side heat exchanger may be overlapped with each other in a direction of the air flow.

Because refrigerant is in a gas phase in the refrigerant superheat areas, the refrigerant absorbs only sensible heat from the air flow. That is, the air flow is not sufficiently cooled in the refrigerant superheat areas. Therefore, when air passes through the overlapped refrigerant superheat areas, the air may not be sufficiently cooled in the heat exchangers.

SUMMARY OF THE INVENTION

In view of the foregoing and other problems, it is an object of the present invention to provide an evaporator unit and an ejector type refrigeration cycle, in which a temperature distribution of air flowing from a downwind side heat exchanger can be made uniform.

According to an example of the present invention, an evaporator unit includes an ejector, an upwind side heat exchanger and a downwind side heat exchanger. The ejector has a nozzle for decompressing refrigerant, and a refrigerant suction port, from which refrigerant is drawn by a high-speed flow of refrigerant jetted from the nozzle. The upwind side heat exchanger is located at an upwind side in an air flow for exchanging heat with refrigerant, and evaporates a discharge side refrigerant flowing out of an outlet of the ejector. The downwind side heat exchanger is located at a downwind side of the upwind side heat exchanger in the air flow, and at least a part of the downwind side heat exchanger evaporates a suction side refrigerant to be drawn into the refrigerant suction port of the ejector. The upwind side heat exchanger has a refrigerant superheat area, which is offset from a refrigerant superheat area of the downwind side heat exchanger in a direction perpendicular to the air flow.

Accordingly, a temperature distribution of air flowing from the downwind side heat exchanger can be made uniform.

The evaporator unit can be suitably used for an ejector type refrigeration cycle including a compressor and a radiator. Furthermore, the downwind side heat exchanger may be provided with a first heat exchanging portion for evaporating the discharge side refrigerant, and a second heat exchanging portion for evaporating the suction side refrigerant. The evaporator unit has an occupancy rate of the second heat exchanging portion to the downwind side heat exchanger. The evaporator unit has a flowing ratio of a flowing amount of the suction side refrigerant to a flowing amount of refrigerant discharged from the compressor, and the flowing ratio can be set in accordance with the occupancy rate.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
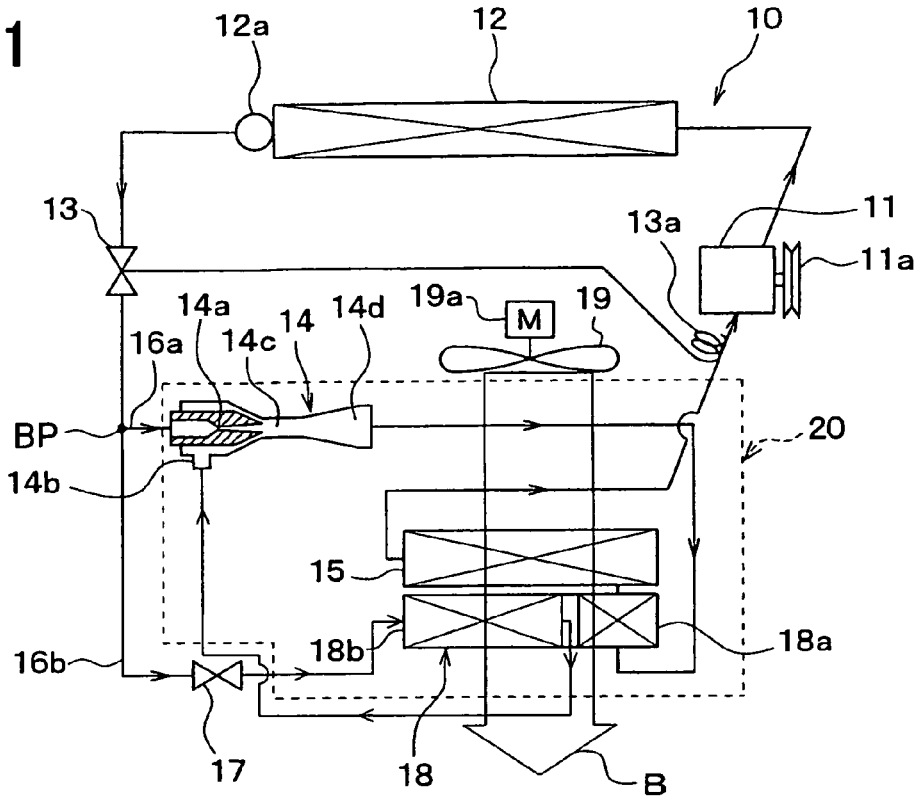
FIG. 1 is a schematic diagram showing an ejector type refrigeration cycle according to a first embodiment of the present invention.

An ejector type refrigeration cycle 10 shown in FIG. 1 is typically used in a refrigeration cycle device for a vehicle in a first embodiment. In the ejector type refrigeration cycle 10, a compressor 11 for drawing and compressing refrigerant is driven by a vehicle engine (not shown) through an electromagnetic clutch 11*a* and a belt (not shown).

A discharge variable compressor or a discharge-fixed compressor can be used as the compressor 11. The discharge variable compressor can change its refrigerant-discharging capacity by changing its discharging amount of refrigerant. The discharge-fixed compressor controls its refrigerant-discharging capacity by changing its operation rate by intermitting the electromagnetic clutch 11*a*. Alternatively, an electric compressor may be used as the compressor 11. In this case, its refrigerant-discharging capacity can be controlled by a rotation speed of an electric motor.

A radiator 12 is connected to a refrigerant discharging side of the compressor 11. In the radiator 12, heat is exchanged between a high-pressure refrigerant flowing from the compressor 11 and outside air, e.g., air outside of a vehicle compartment, sent by a cooling fan (not shown). Thus, the high-pressure refrigerant can be cooled.

In the first embodiment, refrigerant such as chlorofluorocarbon-based refrigerant or hydrocarbon-based refrigerant is used in the ejector type refrigeration cycle 10. Because a high-pressure of refrigerant is not higher than a critical pressure, a subcritical cycle can be constructed by vapor compression. Therefore, the radiator 12 functions as a condenser for cooling and condensing refrigerant.

A receiver 12*a* is provided at an outlet side of the radiator 12. The receiver 12*a* is shaped into a longitudinally elongated tank, and operates as a liquid/vapor separator. The separator separates refrigerant into vapor and liquid, and stores extra liquid refrigerant of the cycle 10. The receiver 12*a* has its outlet at a bottom side of the tank, and liquid refrigerant is discharged from the outlet. In the first embodiment, the receiver 12*a* is integrally formed with the radiator 12.

Alternatively, a condenser including a condensing heat exchanger, a receiver and a supercooling heat exchanger may be used as the radiator 12. In this case, the condensing heat exchanger is positioned at an upstream side of refrigerant flow. Refrigerant flows from the condensing heat exchanger into the receiver, and the receiver separates the refrigerant into vapor and liquid. Then, the supercooling heat exchanger supercools the saturated liquid refrigerant flowing from the receiver.

A thermal expansion valve 13 is connected to an outlet side of the receiver 12*a*. The expansion valve 13 decompresses high-pressure liquid refrigerant flowing from the receiver 12*a* into middle-pressure refrigerant, and controls a flow amount of refrigerant.

Specifically, the expansion valve 13 includes a sensing part 13*a* at a suction side passage of the compressor 11. The sensing part 13*a* detects a superheat degree of refrigerant at the suction side passage of the compressor 11 based on a temperature and a pressure. Then, an opening degree of the expansion valve 13 is controlled such that the superheat degree is to be a predetermined value.

A branch point BP for branching refrigerant flow is located at the outlet side of the expansion valve 13. One branched refrigerant flows through a refrigerant passage 16*a*, and the other branched refrigerant flows through a branch passage 16*b*. The passages 16*a*, 16*b* are connected to an evaporator unit 20 to be described below.

The evaporator unit 20 includes an ejector 14, an upwind side heat exchanger 15 and a downwind side heat exchanger 18, which are integrated, as shown in FIG. 1. The downwind side heat exchanger 18 is constructed with a first evaporator (discharge side evaporator) 18*a* having a refrigerant outlet connected to the upwind side heat exchanger 15, and a second evaporator (suction side evaporator) 18*b* connected to a refrigerant suction port 14*b* of the ejector 14. The integrated evaporator unit 20 will be specifically described below.

The refrigerant passage 16*a* from the branch point BP is connected to an inlet of a nozzle 14*a* of the ejector 14 in the evaporator unit 20. The ejector 14 decompresses refrigerant, and circulates refrigerant by using a drawing operation of refrigerant flow ejected from the nozzle 14*a* at high speed.

The ejector 14 includes the nozzle 14*a* and the suction port 14*b*. The nozzle 14*a* further decompresses and expands the middle-pressure refrigerant flowing from the refrigerant passage 16*a* by throttling a passage area. The suction port 14*b* is arranged in the same space as a refrigerant jetting port of the nozzle 14, and draws vapor refrigerant flowing from the second evaporator 18*b* of the downwind side heat exchanger 18 to be described below.

Further, the ejector 14 includes a mixing part 14*c*, and a diffuser 14*d* at the downstream side of refrigerant flow jetted by the nozzle 14*a*. The mixing part 14*c* mixes high-speed refrigerant jetted by the nozzle 14*a* and refrigerant drawn through the suction port 14*b*. The diffuser 14*d* is a pressure-increasing part at the downstream side of refrigerant flowing from the mixing part 14*c*.

The diffuser 14*d* is formed into a shape gradually increasing a passage area for refrigerant, and reduces a velocity of refrigerant flow so as to increase a pressure of the refrigerant. That is, the diffuser 14*d* converts a velocity energy of refrigerant into a pressure energy. An outlet side of the diffuser 14*d* is connected to the first evaporator 18*a* of the downwind side heat exchanger 18.

The downwind side heat exchanger 18 absorbs heat by evaporating refrigerant, and includes the first evaporator 18*a* and the second evaporator 18*b*. The first evaporator 18*a* evaporates a discharge side refrigerant flowing out of the diffuser 14*d* of the ejector 14. The second evaporator 18*b* evaporates a suction side refrigerant to be drawn into the ejector 14 through the suction port 14*b*.

An outlet side of the first evaporator 18*a* is connected to an inlet side of the upwind side heat exchanger 15. In contrast, an inlet side of the second evaporator 18*b* is connected to the branch passage 16*b*, and an outlet side of the second evaporator 18*b* is connected to the suction port 14*b* of the ejector 14.

In the upwind side heat exchanger 15, low-pressure refrigerant absorbs heat, because heat is exchanged between refrigerant flowing from the first evaporator 18*a* and air flow B sent by a blower 19. The blower 19 is an electric fan driven by a motor 19*a*, and the motor 19*a* is supplied with a control voltage output from an air-conditioning device (not shown). An outlet side of the upwind side heat exchanger 15 is connected to a suction side of the compressor 11.

The suction side refrigerant exchanges heat in the second evaporator 18*b*, and the discharge side refrigerant exchanges heat in the first evaporator 18*a* and the upwind side heat exchanger 15.

Here, the upwind side heat exchanger 15 is located at an upwind side of air flow B sent by the blower 19, and the downwind side heat exchanger 18 is located at the downwind side of the air flow B, as shown in FIG. 1. The air flow B is cooled by the upwind side heat exchanger 15, and then the air flow B cooled by the upwind side heat exchanger 15 is further cooled by both the first and second evaporators 18*a*, 18*b* in the downwind side heat exchanger 18.

Thus, a single space to be cooled can be cooled using the air flow B by the heat exchangers 15, 18. For example, when the ejector type refrigeration cycle 10 is used for a refrigerator in a vehicle, a space in the refrigerator becomes the space to be cooled. When the ejector type refrigeration cycle 10 is used in an air-conditioning device for a vehicle, a space in the vehicle compartment becomes the space to be cooled.

The branch passage 16*b* is connected to the downwind side heat exchanger 18. Specifically, the branch passage 16*b* is connected to the second evaporator 18*b* of the downwind side heat exchanger 18 in the evaporator unit 20.

A throttle 17 is arranged in the branch passage 16*b* at an upstream refrigerant side of the second evaporator 18*b*. The throttle 17 decompresses refrigerant flowing toward the second evaporator 18*b*, and controls an amount of the refrigerant flowing toward the second evaporator 18*b*. In the first embodiment, the throttle 17 is constructed with a capillary tube. Alternatively, the throttle 17 may be constructed with a fixed throttle such as an orifice.

Figure 2:
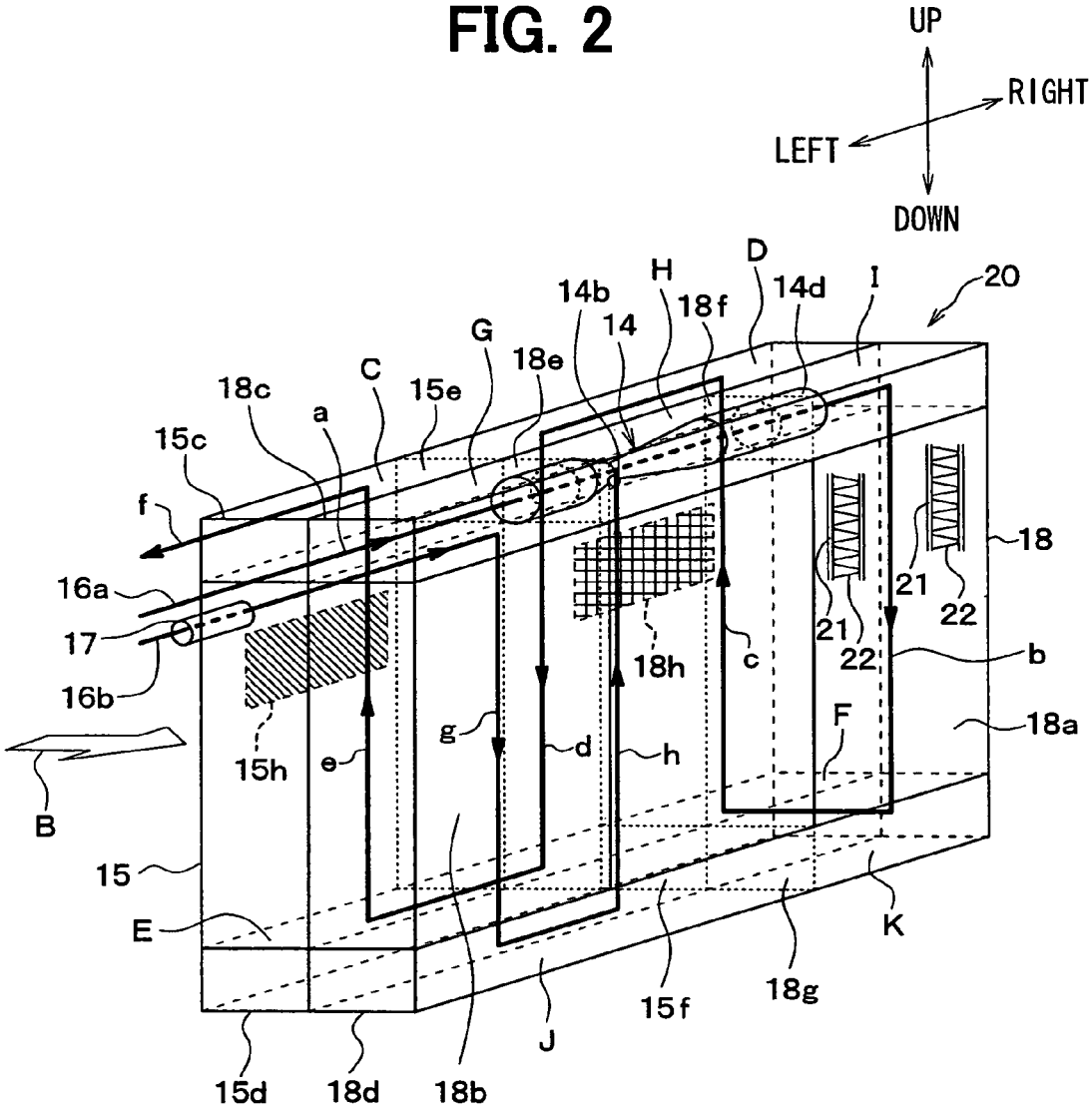
FIG. 2 is a schematic perspective view showing an evaporator unit according to the first embodiment.

FIG. 2 shows the evaporator unit 20, which is integrally formed with the ejector 14, the upwind side heat exchanger 15 and the downwind side heat exchanger 18. A specific structure of the evaporator unit 20 will be described with reference to FIG. 2. The arrows UP, DOWN, LEFT and RIGHT are defined from a viewpoint on a downwind side of the air flow B. The ejector 14 is disposed at an upper side of the evaporator unit 20. An upstream side of the ejector 14 corresponds to the left side in FIG. 2, and a downstream side of the ejector 14 corresponds to the right side in FIG. 2.

The evaporators 15, 18 have the same basic construction. Each of the evaporators 15, 18 includes plural tubes 21 extending in up-and-down direction and plural fins 22 disposed between adjacent tubes 21.

The tube 21 constructs a refrigerant passage, and is made of a flat tube whose sectional shape is flat along the direction of air flow B. The fin 22 is a corrugated fin formed by bending a thin plate into a wavy shape. Due to the wavy shape, a heat-exchanging amount between air flow B and refrigerant can be increased, because heat transmission area is increased. Sets of the tube 21 and the fin 22 adjacent to each other are layered and connected in the right-and-left direction.

Only a part of the layered structure of the tube 21 and the fin 22 is shown in FIG. 2. However, the layered structure is arranged in an entire area of the heat exchangers 15, 18. Air flow B sent by the blower 19 passes through a hollow part of the layered structure. However, the fins 22 may be eliminated in the heat exchangers 15, 18.

Header tanks 15*c*, 18*c* are disposed at top sides of the heat exchangers 15, 18, respectively. Header tanks 15*d*, 18*d* are disposed at bottom sides of the heat exchangers 15, 18, respectively. The header tanks 15*c*, 15*d*, 18*c*, 18*d* collect and distribute refrigerant, and ends of the tubes 21 in a longitudinal (up-and-down) direction are connected to the header tanks 15*c*, 15*d*, 18*c*, 18*d*.

Specifically, each of the tanks 15*c*, 15*d*, 18*c*, 18*d* has tube-fitting holes (not shown), to which the ends of the tubes 21 are inserted and connected, so that the tubes 21 communicates with inner spaces of the tanks 15*c*, 15*d*, 18*c*, 18*d*.

The tubes 21 of the heat exchangers 15, 18 construct the refrigerant passages, and the passages are independent from each other in both the heat exchangers 15, 18. The tanks 15*c*, 15*d*, 18*c*, 18*d* construct the tank inner spaces for gathering and distributing refrigerant, and the tank inner spaces are independent from each other. Thereby, each of the tanks 15*c*, 15*d*, 18*c*, 18*d* distributes refrigerant into corresponding tubes 21, and collects refrigerant flowing out of corresponding tubes 21.

Separators 15*e*, 15*f*, 18*e*, 18*f*, 18*g* are disposed inside of the tanks 15*c*, 15*d*, 18*c*, 18*d*. The separators 15*e*, 15*f*, 18*e*, 18*f*, 18*g* are located to further separate the inner spaces of the tanks 15*c*, 15*d*, 18*c*, 18*d*.

Specifically, the separator 15*e* is disposed in the tank 15*c*, and separates the inner space of the tank 15*c* into a left space C having about one-third volume and a right space D having about two-thirds volume. The separator 15*f* is disposed in the tank 15*d*, and separates the inner space of the tank 15*d* into a left space E having about two-thirds volume and a right space F having about one-third volume.

The separators 18*e*, 18*f* are disposed in the tank 18*c*, and separates the inner space of the tank 18*c* into a left space G, a middle space H and a right space I, in which each space has about one-third volume. The separator 18*g* is disposed in the tank 18*d*, and separates the inner space of the tank 18*d* into a left space J having about two-thirds volume and a right space K having about one-third volume.

A downstream side of the branch passage 16*b* is connected to the left space G of the tank 18*c*. Refrigerant can communicate between the right space F of the tank 15*d* and the right space K of the tank 18*d* through a communication hole (not shown). The ejector 14 is disposed in the tank 18*c*, and a longitudinal direction of the ejector 14 is in parallel to a longitudinal direction of the tank 18*c*. A downstream side of the refrigerant passage 16*a* is connected to the nozzle 14*a* of the ejector 14, as described above. The suction port 14*b* is disposed in the space H of the tank 18*c*, and an outlet side of the diffuser 14*d* is arranged in the right space I. Thus, the suction port 14*b* is directly open to the space H, and refrigerant flowing from the diffuser 14*d* directly flows into the right space I of the tank 18*c*.

As shown in FIG. 2, the ejector 14 and the tanks 15*c*, 15*d*, 18*c*, 18*d* of the heat exchangers 15, 18 are integrated as the evaporator unit 20 such that the upwind side heat exchanger 15 is disposed at an upwind side of the air flow B and the downwind side heat exchanger 18 is disposed at the downwind side of the air flow B.

The heat exchangers 15, 18, i.e., the evaporator unit 20 except for the ejector 14, are made of aluminum having a high heat transmission performance and a high braze performance, and integrated by brazing. In this embodiment, the tanks 15*c*, 18*c* are respectively formed and then integrated. Alternatively, the tanks 15*c*, 18*c* may be integrally formed with one member in order to reduce a process of brazing the tanks 15*c*, 18*c*. Similarly, the tanks 15*d*, 18*d* may be integrally formed with one member in order to reduce a process of brazing the tanks 15*d*, 18*d*.

A high-accuracy micropassage is included in the nozzle 14*a*. If the ejector 14 is brazed, the nozzle 14*a* may be thermally deformed by a high-temperature, e.g., about 600° C., at the aluminum-brazing time. In this case, a shape and a size of the micropassage of the nozzle 14*a* cannot be kept as specified in design. Therefore, the ejector 14 is fitted inside of the tank 18*c*, after the heat exchangers 15, 18 (tanks 15*c*, 15*d*, 18*c*, 18*d*) are integrally brazed.

Specifically, the ejector 14 is inserted into a through hole (not shown) in the separators 18*e*, 18*f* from an end of the tank 18*c* in a tank longitudinal direction, and fixed to the separators 18*e*, 18*f* by screwing, for example. Because the ejector 14 and the separators 18*e*, 18*f* are fixed and sealed through an O-ring (not shown), refrigerant is restricted from leaking through the through hole between the ejector 14 and the separators 18*e*, 18*f*. Therefore, the spaces G, H do not communicate with each other through the through hole, and the spaces H, I do not communicate with each other through the through hole.

Next, a refrigerant flow path in the evaporator unit 20 will be described. First, refrigerant flows from a downstream side of the refrigerant passage 16*a* into the nozzle 14*a* of the ejector 14 in the direction "a" shown in FIG. 2. Then, refrigerant is decompressed while flowing through the nozzle 14*a*, the mixing part 14*c* and the diffuser 14*d*. The decompressed low-pressure refrigerant gathers in the space I of the tank 18*c*.

The refrigerant in the space I is distributed into the tubes 21 disposed at right side of the downwind side heat exchanger 18, and flows downward in the direction "b". Then, refrigerant gathers in the space K of the tank 18*d*. Because the space K communicates with the space F of the tank 15*d*, refrigerant flows into the space F.

The refrigerant in the space F is distributed into the tubes 21 disposed at right side of the upwind side heat exchanger 15, and flows upward in the direction "c". Then, refrigerant flows into the space D of the tank 15*c*. Refrigerant flows leftward in the space D, and is distributed into the tubes 21 disposed at a center area of the upwind side heat exchanger 15. Then, refrigerant flows downward in the direction "d", and flows into the space E of the tank 15*d*.

Refrigerant flows leftward in the space E, and is distributed into the tubes 21 disposed at left side of the upwind side heat exchanger 15. Then, refrigerant flows upward in the direction "e", and gathers in the space C of the tank 15*c*. The refrigerant in the space C flows out of the tank 15*c* in the direction "f", and flows into the suction side of the compressor 11.

The discharge side refrigerant passing through the first evaporator 18*a* of the downwind side heat exchanger 18 and the upwind side heat exchanger 15 changes its flowing direction once or more times (e.g., twice in this embodiment), in the upwind side heat exchanger 15. The discharge side refrigerant becomes vapor refrigerant having a superheat degree in a refrigerant superheat area 15*h* disposed at up and left side of the upwind side heat exchanger 15, indicated in the diagonally shaded area shown in FIG. 2.

Next, low-pressure refrigerant decompressed by the throttle 17 flows from a downstream side of the branch passage 16*b* into the space G of the tank 18*c*. The refrigerant in the space G is distributed into the tubes 21 disposed at left side of the downwind side heat exchanger 18, and flows downward in the direction "g". Then, refrigerant flows into the space J of the tank 18*d*.

Refrigerant flows rightward in the space J, and is distributed into the tubes 21 disposed at a center area of the downwind side heat exchanger 18. Then, refrigerant flows upward in the direction "h", and gathers in the space H of the tank 18*c*. The refrigerant in the space H is drawn into the ejector 14 through the suction port 14*b*.

The suction side refrigerant passing through the second evaporator 18*b* of the downwind side heat exchanger 18 changes its flowing direction once in the downwind side heat exchanger 18. The suction side refrigerant becomes vapor refrigerant having a superheat degree in a refrigerant superheat area 18*h* positioned at up and middle side of the downwind side heat exchanger 18, indicated in the checkered area shown in FIG. 2. The refrigerant superheat areas 15*h*, 18*h* are located not to be overlapped with each other in the direction of air flow B. That is, the upwind side heat exchanger 15 has the refrigerant superheat area 15*h*, which is offset from a refrigerant superheat area 18*h* of the downwind side heat exchanger 18 in a direction perpendicular to the air flow B.

Further, the suction side refrigerant exchanges heat only in an area indicated by the directions "g" and "h" in the downwind side heat exchanger 18. Here, an occupancy rate of the second evaporator 18*b* is set about two-thirds (70%) of the downwind side heat exchanger 18 due to the separators 18*f*, 18*g*. The occupancy rate represents a rate of the occupancy area of the second evaporator 18*b* to the downwind side heat exchanger 18. This rate can be easily controlled by changing the arrangement positions of the separators 18*f*, 18*g*.

Next, an operation of the ejector type refrigeration cycle 10 in the first embodiment will be described. When the compressor 11 is driven by the vehicle engine, refrigerant is compressed into high-temperature and high-pressure refrigerant, and discharged from the compressor 11. Then, the high-temperature refrigerant flows into the radiator 12, and is cooled and condensed by outside air. The high-pressure refrigerant flowing out of the radiator 12 flows into the receiver 12*a*, and is separated into vapor and liquid. The liquid refrigerant flows into the expansion valve 13 from the receiver 12*a*.

A flowing amount of refrigerant is controlled by adjusting an opening degree of the expansion valve 13 such that refrigerant flowing out of the upwind side heat exchanger 15, corresponding to a refrigerant to be drawn by the compressor 11, has a predetermined superheat degree. The high-pressure refrigerant is decompressed by the expansion valve 13. The refrigerant decompressed by the expansion valve 13 has a middle-pressure, and is branched at the branch point BP. Then, refrigerant separately flows into the refrigerant passage 16*a* and the branch passage 16*b*.

Refrigerant flowing into the ejector 14 through the refrigerant passage 16*a* is decompressed and expanded at the nozzle 14*a*. Therefore, a pressure energy of refrigerant is converted into a velocity energy at the nozzle 14*a*, and the refrigerant is ejected at high-speed from the jetting port of the nozzle 14*a*. At the same time, vapor refrigerant flowing out of the second evaporator 18*b* is drawn into the ejector 14 through the suction port 14*b*, because a pressure of refrigerant at the jetting port of the nozzle 14*a* is lowered by the high-speed ejection.

The refrigerant ejected by the nozzle 14*a* and the refrigerant drawn through the suction port 14*b* are mixed in the mixing part 14*c*, and the mixed refrigerant flows into the diffuser 14*d*. The velocity (expansion) energy of the mixed refrigerant is converted into the pressure energy, because a passage area is enlarged in the diffuser 14*d*. Thus, a pressure of the mixed refrigerant is increased in the diffuser 14*d*.

Then, refrigerant flowing from the diffuser 14*d* flows into the first evaporator 18*a* of the down wind side heat exchanger 18 and the upwind side heat exchanger 15 in the directions "b", "c", "d" and "e" of FIG. 2. Meanwhile, refrigerant absorbs heat from the air flow B sent by the blower 19, and evaporates. The evaporated gas refrigerant is drawn and compressed by the compressor 11 again.

In contrast, refrigerant flowing into the branch passage 16*b* from the branch point BP flows into the second evaporator 18*b* of the downwind side heat exchanger 18 in the directions "g" and "h" of FIG. 2. Meanwhile, refrigerant absorbs heat from the air flow B having passed through the upwind side heat exchanger 15, and evaporates. The evaporated gas refrigerant is drawn into the ejector 14 through the suction port 14*b*.

Figure 8:
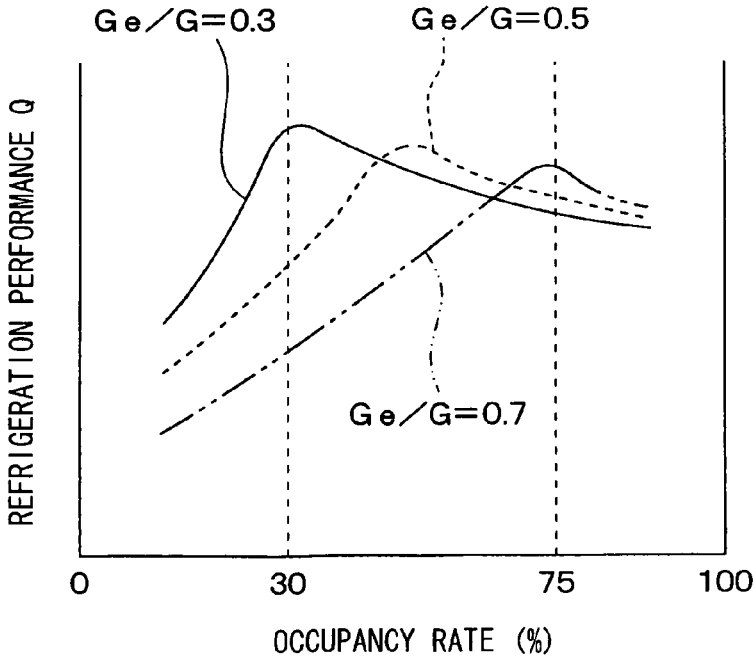
FIG. 8 is a graph showing a relationship between an occupancy rate of a downwind side heat exchanger and a refrigeration performance.

Here, the throttle 17 controls a flowing ratio Ge/G to about 0.7, in which Ge represents a flowing amount of the refrigerant (i.e., suction side refrigerant) to be drawn into the suction port 14*b*, and G represents a flowing amount of refrigerant discharged from the compressor 11. As shown in FIG. 8, when the occupancy rate of the second evaporator 18*b* to the downwind side heat exchanger 18 is in a range between 30% and 75%, a peak point of a refrigeration performance Q (refrigeration capacity) of the ejector type refrigeration cycle 10 exists respective to a predetermined flowing ratio Ge/G. Further, when the flowing ratio Ge/G is in a range between 0.3 and 0.7, the ejector type refrigeration cycle 10 can have a high refrigeration performance.

According to the first embodiment, cooling operations are simultaneously performed in the heat exchangers 15, 18. That is, when the refrigerant (i.e., discharge side refrigerant) discharged from the outlet of the ejector 14 flows into the first evaporator 18*a* and the upwind side heat exchanger 15, the suction side refrigerant flows into the second evaporator 18*b* at the same time.

Moreover, the air flow B sent by the blower 19 can be cooled while passing through the upwind side heat exchanger 15 and the downwind side heat exchanger 18 in this order. In that time, a pressure of refrigerant evaporated in the upwind side heat exchanger 15 can be used as a pressure increased in the diffuser 14*d*. In contrast, a pressure of refrigerant evaporated in the second evaporator 18*b* of the downwind side heat exchanger 18 corresponds to the lowest pressure of refrigerant jetted by the nozzle 14*a*, because the second evaporator 18*b* of the downwind side heat exchanger 18 is connected to the suction port 14*b*.

Thus, the pressure (temperature) of the refrigerant evaporated in the second evaporator 18*b* of the downwind side heat exchanger 18 can be made lower than the pressure (temperature) of the refrigerant evaporated in the upwind side heat exchanger 15 and the first evaporator 18*a* of the downwind side heat exchanger 18. Therefore, the air flow B can be effectively cooled, because a temperature difference can be secured between the air flow B and the refrigerants to be evaporated in the second evaporator 18*b* and the upwind side heat exchanger 15.

Further, because a downstream refrigerant side of the upwind side heat exchanger 15 is connected to a suction side of the compressor 11, the compressor 11 can draw refrigerant having a pressure increased in the diffuser 14*d*. Thus, a driving force for the compressor 11 can be reduced, because a suction side pressure of the compressor 11 becomes larger due to the increased pressure in the diffuser 14*d*.

Furthermore, advantages described below can be provided by using the evaporator unit 20 in the ejector type refrigeration cycle 10.

Even if the air flow B is not sufficiently cooled in the refrigerant superheat area 15*h* of the upwind side heat exchanger 15, the air flow B can be sufficiently cooled in the downwind side heat exchanger 18, because the superheat areas 15*h*, 18*h* are located not to be overlapped with each other in the direction of the air flow B.

In contrast, the air flow B flowing toward the refrigerant superheat area 18*h* has been already sufficiently cooled in the upwind side heat exchanger 15. Therefore, temperature distribution can be made uniform among air flowing out of the downwind side heat exchanger 18.

A direction of the discharge side refrigerant flowing in the upwind side heat exchanger 15 is opposite to a direction of the suction side refrigerant flowing in the second evaporator 18*b*. This is because the discharge side refrigerant passing through the upwind side heat exchanger 15 changes its flowing direction once or more times (e.g., twice in this embodiment), and because the suction side refrigerant passing through the second evaporator 18*b* changes its flowing direction once. Thus, the refrigerant superheat areas 15*h*, 18*h* can be easily located not to be overlapped with each other in the direction of the air flow B.

In an overlapped area of the upwind side heat exchanger 15 and the downwind side heat exchanger 18 in the direction of the air flow B, the direction of the discharge side refrigerant is opposite to the direction of the suction side refrigerant. Therefore, the downstream refrigerant-side heat-exchanging area in the upwind side heat exchanger 15 and the downstream refrigerant-side heat-exchanging area in the downwind side heat exchanger 18 are not overlapped with each other. Because the superheat areas 15*h*, 18*h* are positioned in the downstream refrigerant-side heat-exchanging areas, respectively, the superheat areas 15*h*, 18*h* are surely not overlapped with each other in the direction of the air flow B.

The ejector type refrigeration cycle 10 can have a high refrigeration performance, as shown in FIG. 8, because the occupancy rate of the second evaporator 18*b* to the downwind side heat exchanger 18 is about 70%, and because the flowing ratio Ge/G is controlled to about 0.7. The flowing ratio Ge/G can be easily controlled by changing a condition of the throttle 17. Therefore, even if the occupancy rate is changed in the downwind side heat exchanger 18, the refrigeration performance Q can be easily improved by changing the condition of the throttle 17.

Because the ejector 14 is located inside of the tank 18*c* of the downwind side heat exchanger 18, the downwind side heat exchanger 18 and the ejector 14 can be easily and accurately fitted to the ejector type refrigeration cycle 10, and a pressure loss can be decreased when refrigerant flows from the downwind side heat exchanger 18 into the ejector 14 through the suction port 14*b*.

In this embodiment, the discharge side refrigerant of the ejector 14 can flow into the upwind side heat exchanger 15 through the first evaporator 18*a* of the downwind side heat exchanger 18. Thereby, the discharge side refrigerant can flow into the upwind side heat exchanger 15 through a flexible position in the first evaporator 18*a*, and a position for changing the flowing direction of the discharge side refrigerant can be more freely set.

Moreover, a size of a heat-exchanging area can be flexibly controlled in each of the heat exchangers 15, 18. Therefore, the refrigeration performance Q of the ejector type refrigeration cycle 10 can be easily controlled by changing the flowing amount of refrigerant. Here, the refrigeration performance Q represents a sum of increased enthalpies, when the discharge side refrigerant and the suction side refrigerant absorb heat from the air flow B. The increased enthalpy represents a product of the refrigerant amount and an increased specific enthalpy per unit of weight.

Furthermore, because a refrigerant-inflowing part from the passages 16*a*, 16*b*, and a refrigerant-discharging part toward the compressor 11 are closely located in the evaporator unit 20, the evaporator unit 20 can be more easily and accurately mounted to the ejector type refrigeration cycle 10.

Second Embodiment

Figure 3:
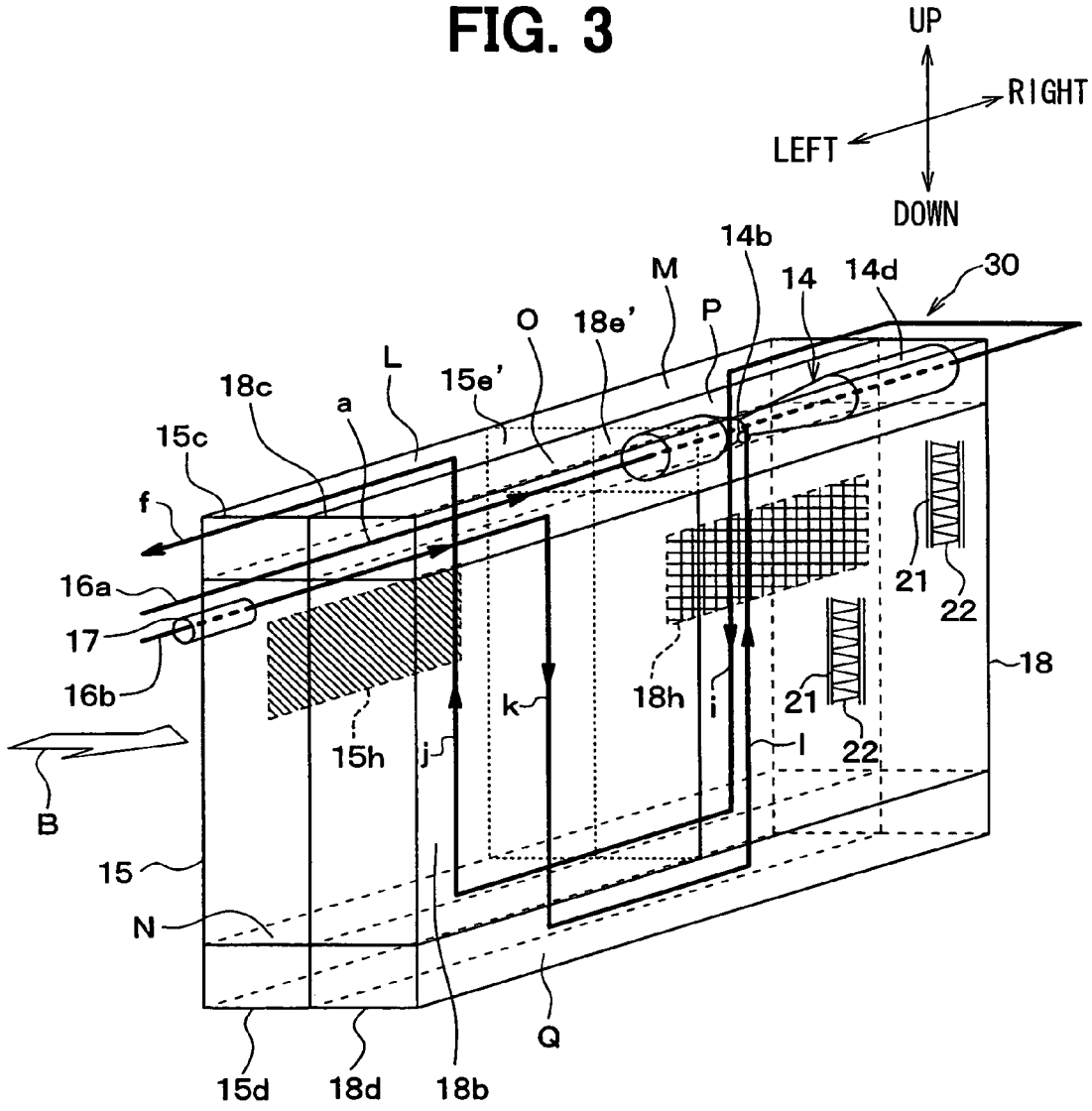
FIG. 3 is a schematic perspective view showing an evaporator unit according to a second embodiment.

An evaporator unit 30 shown in FIG. 3 is used in an ejector type refrigeration cycle 10 in a second embodiment. An upwind side heat exchanger 15 and a downwind side heat exchanger 18 in the second embodiment have a basic construction similar to that in the first embodiment.

Arrangement positions of separators and an ejector 14 are different in the second embodiment from the first embodiment. Therefore, a refrigerant flow path is also different in the second embodiment.

First, a separator 15*e*' is located in the tank 15*c*, and separates an inner space of the tank 15*c* into a left space L and a right space M, which have about half volume of the inner space of the tank 15*c*, respectively. The tank 15*d* constructs one space N without a separator.

A separator 18*e*' is located in the tank 18*c*, and separates an inner space of the tank 18*c* into a left space O and a right space P, which have about half volume of the inner space of the tank 18*c*, respectively. The tank 18*d* constructs one space Q without any separator. A downstream side of the branch passage 16*b* is connected to the space O of the tank 18*c*.

The ejector 14 is located inside of the tank 18*c*. A downstream side of the refrigerant passage 16*a* is connected to the nozzle 14*a* of the ejector 14, and the suction port 14*b* is arranged in the space P of the tank 18*c*. Thus, the suction port 14*b* is directly open to the space P.

The discharge side refrigerant flowing from the diffuser 14*d* flows into the space M of the tank 15*c* through a pipe disposed outside of the tank 18*c*. Alternatively, a passage for introducing the discharge side refrigerant into the space M may be formed in the tank 18*c*. The ejector 14 is fitted inside of the tank 18*c*, after the heat exchangers 15, 18, e.g., the tanks 15*c*, 15*d*, 18*c*, 18*d*, are integrally brazed, similarly to the first embodiment.

A refrigerant flow path in the evaporator unit 30 having the above-described construction will be described. First, refrigerant flows from a downstream side of the refrigerant passage 16*a* into the ejector 14 in the direction "a". Refrigerant is decompressed in the nozzle 14*a* of the ejector 14, and the decompressed low-pressure refrigerant flows into the space M of the tank 15*c* through the pipe outside of the tank 18*c*.

The refrigerant in the space M is distributed into the tubes 21 at right side of the upwind side heat exchanger 15, and flows downward in the direction "i". Then, refrigerant flows into the space N of the tank 15*d*, and flows leftward in the space N.

Refrigerant is distributed into the tubes 21 at left side of the upwind side heat exchanger 15, and flows upward in the direction "j". Then, refrigerant gathers in the space L of the tank 15*c*, and flows out of the tank 15*c* into a suction side of the compressor 11 in the direction "f".

The discharge side refrigerant passing through the upwind side heat exchanger 15 changes its flowing direction once in the upwind side heat exchanger 15. The discharge side refrigerant becomes vapor refrigerant having a superheat degree in a refrigerant superheat area 15*h* positioned at up and left side of the upwind side heat exchanger 15 indicated in the diagonally shaded area shown in FIG. 3.

Next, low-pressure refrigerant decompressed by the throttle 17 flows from a downstream side of the branch passage 16*b* into the space O of the tank 18*c*. The refrigerant in the space O is distributed into the tubes 21 disposed at left side of the downwind side heat exchanger 18, and flows downward in the direction "k". Then, refrigerant flows into the space Q of the tank 18*d*.

The refrigerant in the space Q flows rightward, and is distributed into the tubes 21 disposed at right side of the downwind side heat exchanger 18. Refrigerant flows upward in the direction "l", and gathers in the space P of the tank 18*c*. The refrigerant in the space P is drawn into the ejector 14 through the suction port 14*b*.

The suction side refrigerant to be drawn into the suction port 14*b*, while passing through the downwind side heat exchanger 18, changes its flowing direction once in the downwind side heat exchanger 18. The suction side refrigerant becomes vapor refrigerant having a superheat degree in a refrigerant superheat area 18*h* positioned at up and right side of the downwind side heat exchanger 18 indicated in the checkered area shown in FIG. 3. The superheat areas 15*h*, 18*h* are located not to be overlapped with each other in the direction of the air flow B.

In addition, all the downwind side heat exchanger 18 is used as a second (suction side) evaporator 18*b* without a first (discharge side) evaporator 18*a*. That is, the downwind side heat exchanger 18 is not partitioned into the first and second evaporators as in the first embodiment. The other parts in the second embodiment may be made similarly to the first embodiment.

When the ejector type refrigeration cycle 10 is actuated, refrigerant flowing from the diffuser 14*d* flows in the upwind side heat exchanger 15 in the directions "i" and "j". Meanwhile, the refrigerant absorbs heat from the air flow B sent by the blower 19, and evaporates.

In contrast, the low-pressure suction side refrigerant flowing from the branch passage 16*b* flows in the downwind side heat exchanger 18 in the directions "k" and "l". Meanwhile, the suction side refrigerant absorbs heat from the air flow B passing through the upwind side heat exchanger 15, and evaporates.

According to the second embodiment, the same advantages are provided as the first embodiment.

Third Embodiment

Figure 4:
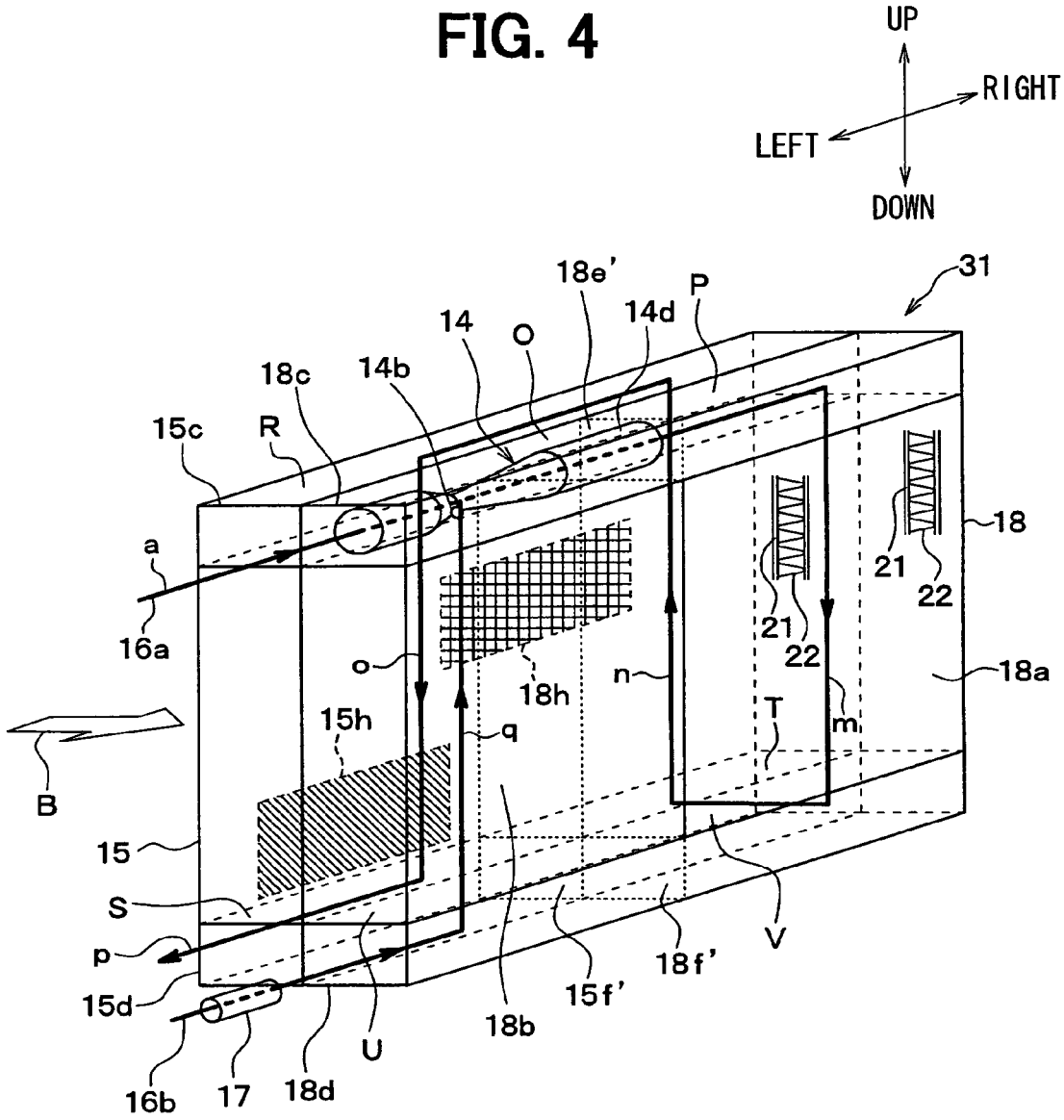
FIG. 4 is a schematic perspective view showing an evaporator unit according to a third embodiment.

An evaporator unit 31 shown in FIG. 4 is used in an ejector type refrigeration cycle 10 in a third embodiment. The evaporator unit 31 is integrally constructed with an ejector 14 and heat exchangers 15, 18, similarly to the evaporator unit 20 in the first embodiment.

Arrangement positions of separators and the ejector 14 are different in the third embodiment from the first embodiment. Therefore, a refrigerant flow path is also different from the first embodiment, in the third embodiment.

First, any separator is not included in the tank 15*c*, and the tank 15*c* forms an inner space R elongated in a tank longitudinal direction. A separator 15*f*' is arranged in the tank 15*d*, and separates an inner space of the tank 15*d* into a left space S and a right space T, which have about half volume of the inner space of the tank 15*d*, respectively.

A separator 18*e*' is located in the tank 18*c*, and separates an inner space of the tank 18*c* into a left space O and a right space P, which have about half volume of the inner space of the tank 18*c*, respectively. A separator 18*f*' is located in the tank 18*d*, and separates an inner space of the tank 18*d* into a left space U and a right space V, which have about half volume of the inner space of the tank 18*d*, respectively. A downstream side of the branch passage 16*b* is connected to the space U of the tank 18*d*. Refrigerant can communicate between the space T of the tank 15*d* and the space V of the tank 18*d* through a communication hole (not shown).

The ejector 14 is arranged inside of the tank 18*c*. A downstream side of the refrigerant passage 16*a* is connected to the nozzle 14*a* of the ejector 14, and the suction port 14*b* of the ejector 14 is arranged in the space O of the tank 18*c*. An outlet of the diffuser 14*d* is arranged in the space P of the tank 18*c*. Thus, the suction port 14*b* is directly open to the space O, and the outlet of the diffuser 14*d* is directly open to the space P.

The ejector 14 is fitted inside of the tank 18*c*, after the heat exchangers 15, 18, e.g., the tanks 15*c*, 15*d*, 18*c*, 18*d*, are integrally brazed, similarly to the first embodiment.

A refrigerant flow path in the evaporator unit 31 having the above-described construction will be described. First, refrigerant flows from a downstream side of the refrigerant passage 16*a* into the ejector 14 in the direction "a". Refrigerant is decompressed in the nozzle 14*a* of the ejector 14, and the decompressed low-pressure refrigerant flows into the space P of the tank 18*c*.

The refrigerant in the space P is distributed into the tubes 21 at right side of the downwind side heat exchanger 18, and flows downward in the direction "m". Then, refrigerant flows into the space V of the tank 18*d*. The refrigerant in the space V flows into the space T, because the space T communicates with the space V.

Then, the refrigerant in the space T is distributed into the tubes 21 at right side of the upwind side heat exchanger 15, and flows upward in the direction "n". Refrigerant flows into the space R of the tank 15*c*, and flows leftward in the space R.

Then, refrigerant is distributed into the tubes 21 at left side of the upwind side heat exchanger 15, and flows downward in the direction "o". Refrigerant flows into the space U of the tank 15*d*, and the refrigerant in the space U flows out of the tank 15*d* toward a suction side of the compressor 11.

The discharge side refrigerant passing through the first evaporator 18*a* of the downwind side heat exchanger 18 and the upwind side heat exchanger 15 changes its flowing direction once in the upwind side heat exchanger 15. Then, the discharge side refrigerant becomes vapor refrigerant having a superheat degree in a refrigerant superheat area 15*h* positioned at down and left side of the upwind side heat exchanger 15 indicated in the diagonally shaded area shown in FIG. 4.

In contrast, low-pressure refrigerant decompressed by the throttle 17 flows from a downstream side of the branch passage 16*b* into the space U of the tank 18*d*. The refrigerant in the space U is distributed into the tubes 21 disposed at left side of the downwind side heat exchanger 18, and flows upward in the direction "q". Then, refrigerant flows into the space O of the tank 18*c*. The refrigerant in the space O is drawn into the ejector 14 through the suction port 14*b*.

Thus, the suction side refrigerant to be drawn into the suction port 14*b* becomes vapor refrigerant having a superheat degree in a refrigerant superheat area 18*h* positioned at up and left side of the downwind side heat exchanger 18 indicated in the checkered area shown in FIG. 4. The superheat areas 15*h*, 18*h* are located not to be overlapped with each other in the direction of the air flow B.

In addition, the suction side refrigerant exchanges heat only in the direction "q" in the downwind side heat exchanger 18, and the occupancy rate of the second evaporator 18*b* to the downwind side heat exchanger 18 is set about half (50%) of the downwind side heat exchanger 18 due to the separators 18*e*', 18*f*'. Therefore, the throttle 17 controls the flowing ratio Ge/G to about 0.5. The other parts in the third embodiment may be made similarly to the first embodiment.

When the ejector type refrigeration cycle 10 is actuated, refrigerant flowing out of the diffuser 14*d* flows in the first evaporator 18*a* of the downwind side heat exchanger 18 and the upwind side heat exchanger 15 in the directions "m", "n" and "o". Meanwhile, the refrigerant absorbs heat from the air flow B sent by the blower 19, and evaporates.

In contrast, the low-pressure suction side refrigerant flowing from the branch passage 16*b* flows in the second evaporator 18*b* of the downwind side heat exchanger 18 in the direction "q". Meanwhile, the suction side refrigerant absorbs heat from the air flow B having passed through the upwind side heat exchanger 15, and evaporates.

Here, the ejector type refrigeration cycle 10 can have a high refrigeration performance Q, because the flowing ratio Ge/G is controlled to about 0.5 in accordance with the occupancy rate of the second evaporator 18*b* of about 50%.

According to the third embodiment, the same advantages are provided as the first embodiment.

Fourth Embodiment

Figure 5:
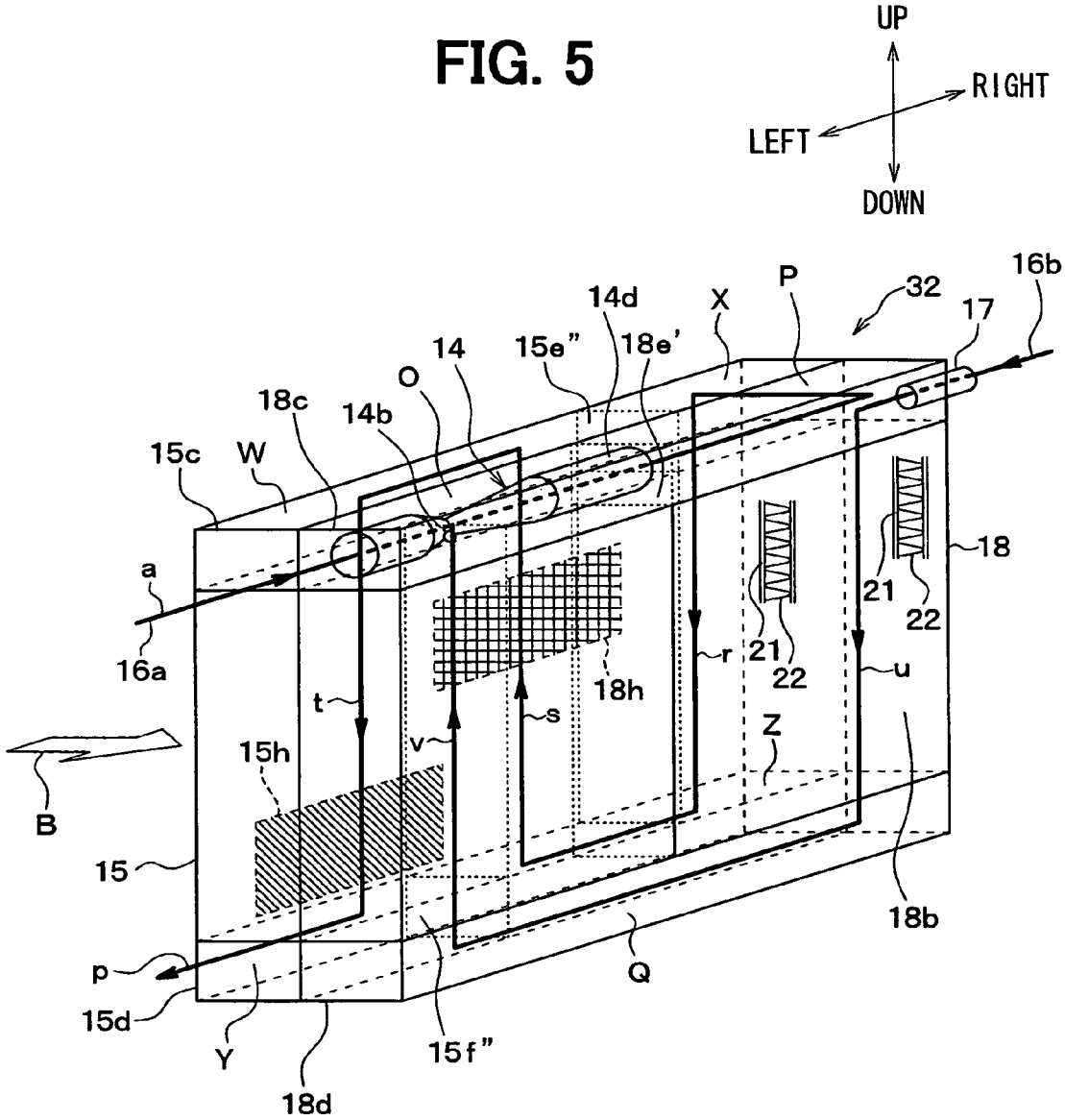
FIG. 5 is a schematic perspective view showing an evaporator unit according to a fourth embodiment.

An evaporator unit 32 shown in FIG. 5 is used in an ejector type refrigeration cycle 10 in a fourth embodiment. The evaporator unit 32 is integrally constructed with an ejector 14 and heat exchangers 15, 18, similarly to the evaporator unit 20 in the first embodiment.

Arrangement positions of separators and the ejector 14 are different in the fourth embodiment from the first embodiment. Therefore, a refrigerant flow path is also different from the first embodiment, in the fourth embodiment.

First, a separator 15*e*" is arranged in the tank 15*c*, and separates an inner space of the tank 15*c* into a left space W having about two-thirds volume of the tank inner space and a right space X having about one-third volume of the tank inner space. A separator 15*f*" is arranged in the tank 15*d*, and separates an inner space of the tank 15*d* into a left space Y having about one-third volume of the inner space and a right space Z having about two-thirds volume of the tank inner space.

A separator 18*e*' is located in the tank 18*c*, and separates an inner space of the tank 18*c* into a left space O and a right space P, which have about half volume of the inner space of the tank 18*c*, respectively. Any separator is not disposed in the tank 18*d*, and the tank 18*d* forms one inner space Q elongated in a tank longitudinal direction. A downstream side of the branch passage 16*b* is connected to the space P of the tank 18*c*.

The ejector 14 is located inside of the tank 18*c*. A downstream side of the refrigerant passage 16*a* is connected to the nozzle 14*a* of the ejector 14, and the suction port 14*b* is arranged in the space O of the tank 18*c*. An outlet of the diffuser 14*d* is arranged in the space P of the tank 18*c*. Thus, the suction port 14*b* is directly open to the space O, and the outlet of the diffuser 14*d* is directly open to the space P.

The refrigerant flowing through the branch passage 16*b* and the refrigerant flowing out of the diffuser 14*d* flow into the space P. Therefore, the space P is further separated into two independent spaces, into which the refrigerants flow, respectively independently.

Specifically, a separator (not shown) for separating the space P into the two independent upper and lower spaces in up-and-down direction is disposed in the space P. The refrigerant flowing from the diffuser 14*d* flows into the upper space, and the refrigerant flowing through the branch passage 16*b* flows into the lower space. The refrigerant flowing from the diffuser 14*d* flows from the upper space of the space P into the space X of the tank 15*c* through a communication hole (not shown). Alternatively, a passage may be additionally provided in the tank 18*c* such that the refrigerant flowing from the diffuser 14*d* can directly flow into the space X.

The ejector 14 is fitted inside of the tank 18*c*, after the heat exchangers 15, 18, e.g., the tanks 15*c*, 15*d*, 18*c*, 18*d*, are integrally brazed, similarly to the first embodiment.

A refrigerant flow path in the evaporator unit 32 having the above-described construction will be described. First, refrigerant flows from the refrigerant passage 16*a* into the ejector 14 in the direction "a". Refrigerant is decompressed in the nozzle 14*a* of the ejector 14, and the decompressed low-pressure refrigerant flows into the space X of the tank 15*c* through the upper space of the space P of the tank 18*c*.

The refrigerant in the space X is distributed into the tubes 21 at right side of the upwind side heat exchanger 15, and flows downward in the direction "r". Then, refrigerant flows into the space Z of the tank 15*d*.

Refrigerant flows leftward in the space Z, and is distributed into the tubes 21 at a center area of the upwind side heat exchanger 15. Then, refrigerant flows upward in the direction "s", and flows into the space W of the tank 15*c*.

Then, refrigerant flows leftward in the space W, and is distributed into the tubes 21 at left side of the upwind side heat exchanger 15. Refrigerant flows downward in the direction "t", and gathers in the space Y of the tank 15*d*. Then, refrigerant flows toward a suction side of the compressor 11 from the tank 15*d* in the direction "p".

The discharge side refrigerant passing through the upwind side heat exchanger 15 changes its flowing direction once or more times (e.g., twice in this embodiment) in the upwind side heat exchanger 15. The discharge side refrigerant becomes vapor refrigerant having a superheat degree in a refrigerant superheat area 15*h* positioned at down and left side of the upwind side heat exchanger 15 indicated in the diagonally shaded area shown in FIG. 5.

In contrast, low-pressure refrigerant decompressed by the throttle 17 flows from a downstream side of the branch passage 16*b* into the space P of the tank 18*c*. The refrigerant in the space P is distributed into the tubes 21 disposed at right side of the downwind side heat exchanger 18, and flows downward in the direction "u". Then, refrigerant flows into the space Q of the tank 18*d*.

Then, refrigerant flows leftward in the space Q, and is distributed into the tubes 21 at left side of the downwind side heat exchanger 18. Refrigerant flows upward in the direction "v", and gathers in the space O of the tank 15*c*. The refrigerant in the space O is drawn into the ejector 14 through the suction port 14*b*.

Thus, the suction side refrigerant to be drawn into the suction port 14*b* becomes vapor refrigerant having a superheat degree in a refrigerant superheat area 18*h* positioned at up and left side of the downwind side heat exchanger 18 indicated in the checkered area shown in FIG. 5. The superheat areas 15*h*, 18*h* are located not to be overlapped with each other in the direction of the air flow B.

In addition, all the downwind side heat exchanger 18 is used as a second (suction side) evaporator 18*b* without a first (discharge side) evaporator 18*a* in the fourth embodiment. The other parts in the fourth embodiment may be made similarly to the first embodiment.

When the ejector type refrigeration cycle 10 is actuated, refrigerant flowing from the diffuser 14*d* flows into the upwind side heat exchanger 15 in the directions "r", "s" and "t". Meanwhile, the refrigerant absorbs heat from the air flow B sent by the blower 19, and evaporates.

In contrast, the low-pressure suction side refrigerant flowing from the branch passage 16*b* flows in the downwind side heat exchanger 18 in the directions "u" and "v". Meanwhile, the suction side refrigerant absorbs heat from the air flow B passing through the upwind side heat exchanger 15, and evaporates.

According to the fourth embodiment, the same advantages are provided as the first embodiment.

Other Embodiments

In the above embodiments, the ejector 14 and the heat exchangers 15, 18 are integrally formed in the evaporator units 20, 30, 31, 32. Alternatively, the other component parts may further be integrated in the evaporator unit 20, 30, 31, 32, in the ejector type refrigeration cycle.

Figure 6:
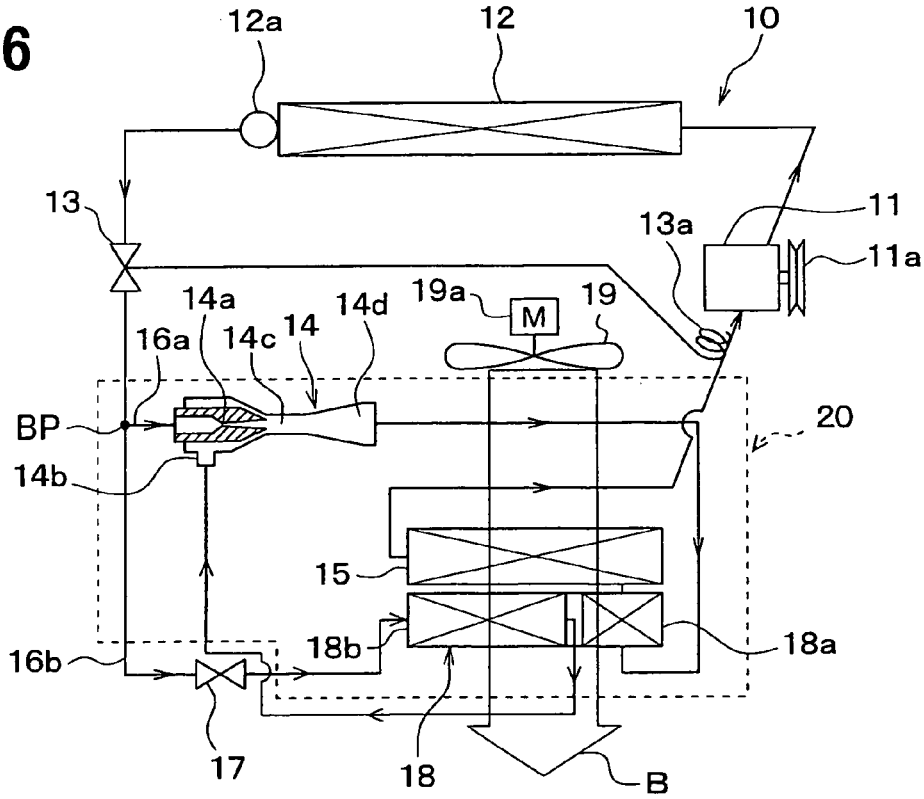
FIG. 6 is a schematic diagram showing an ejector type refrigeration cycle according to a modification of the first embodiment.

For example, as shown in a dashed line in FIG. 6, the branch point BP with the refrigerant passage 16*a* and the branch passage 16*b* may be integrated in the evaporator unit 20. Specifically, a connection block is provided at a left end of the tank 18*c*, and the branch point BP is arranged in the connection block. Furthermore, a refrigerant outlet of the evaporator unit 20, 30, 31, 32 can be formed in the connection block.

Figure 7:
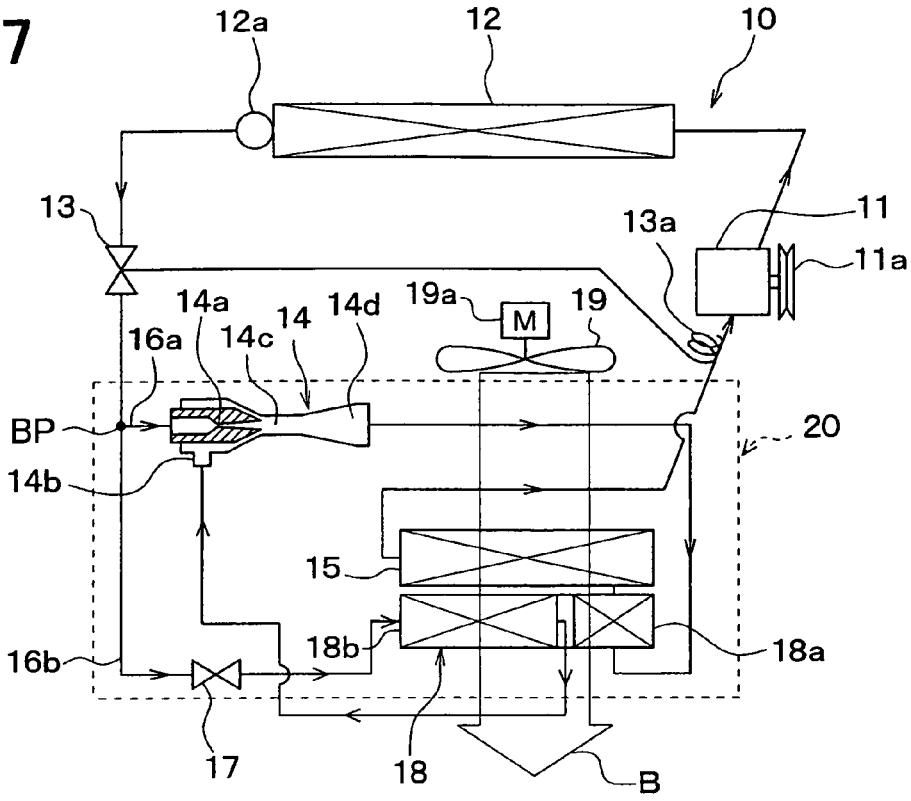
FIG. 7 is a schematic diagram showing an ejector type refrigeration cycle according to another modification of the first embodiment.

Alternatively, as shown in a dashed line in FIG. 7, the branch point BP with the passages 16*a*, 16*b* and the throttle 17 may be integrated in the evaporator unit 20. Alternatively, the expansion valve 13 and the sensing part 13*a* may be integrated in the evaporator unit 20.

In the above embodiments, the evaporator units 20, 30, 31, 32 except for the ejector 14 are integrated by brazing, before the ejector 14 is assembled. Alternatively, a screwing, a swaging, a welding or an adhesive may be used for the integration. Alternatively, the ejector 14 may be fixed by swaging or an adhesive, other than the screwing, as long as the ejector 14 is not thermally deformed.

In the above embodiments, the heat exchangers 15, 18 are closely located to be integrated in the tanks. Alternatively, the heat exchangers 15, 18 may not be closely located. For example, a communication pipe may be disposed between the tanks 15*c*, 18*c* or the tanks 15*d*, 18*d* such that the upwind side heat exchanger 15 is disposed with a space from the downwind side heat exchanger 18. Even in this case, the air flow B having passed through the upwind side heat exchanger 15 can be further cooled in the downwind side heat exchanger 18, as long as the upwind side heat exchanger 15 is located at the upwind side of the air flow B and the downwind side heat exchanger 18 is located at the downwind side of the air flow B.

In the above embodiments, refrigerant such as chlorofluorocarbon-based refrigerant or hydrocarbon-based refrigerant is used in the ejector type refrigeration cycle 10. Alternatively, refrigerant such as carbon dioxide may be used in the ejector type refrigeration cycle 10, a high-pressure of which is equal to or higher than the critical pressure. However, in this case, the receiver 12*a* cannot separate refrigerant into vapor and liquid, because refrigerant is not condensed in the radiator 12 in a supercritical cycle. This is because refrigerant flowing from the compressor 11 is in a supercritical state. Therefore, the receiver 12*a* may be eliminated, and an accumulator, i.e., a low-pressure side vapor/liquid separator, may be arranged at a downstream side of the upwind side heat exchanger 15 (i.e., the suction side of the compressor 11). The same advantages can be provided in this ejector type refrigeration cycle by using the evaporator units 20, 30, 31, 32, only when the superheat areas 15*h*, 18*h* are not overlapped in the heat exchangers 15, 18 in the air flow B.

Further, in the supercritical cycle, the branch point BP may be eliminated, and the downstream side of the expansion valve 13 may be connected to the nozzle 14*a*. Then, liquid refrigerant separated by the accumulator may flow into the second evaporator 18*b*.

In the above embodiments, the throttle 17 is constructed with the capillary tube. Alternatively, the throttle 17 may be constructed with an electric controlling valve, which can control its opening degree by an electric actuator. Alternatively, the throttle 17 may be constructed with a combination of a fixed throttle and an electromagnetic valve.

In the above embodiments, a fixed ejector having the nozzle 14*a* with a constant passage area is used as the ejector 14. Alternatively, a variable ejector may be used as the ejector 14, in which a passage area can be changed. Specifically, a needle is inserted into a passage of a variable nozzle, for example. The passage area can be controlled by controlling a position of the needle with an electric actuator.

In the above embodiments, the evaporator units 20, 30, 31, 32 are used as an indoor side heat exchanger, and the radiator 12 is used as an outdoor side heat exchanger for radiating heat to outside air. Alternatively, the evaporator units 20, 30, 31, 32 may be used as an outdoor side heat exchanger for absorbing heat from a heat source, e.g., outside air, and the radiator 12 may be used as an indoor side heat exchanger for heating a fluid, e.g., air or water, in a heat pump cycle.

In the above embodiments, the ejector type refrigeration cycle 10 is used for a vehicle. Alternatively, the ejector type refrigeration cycle 10 may be used for a fixed apparatus for a house, etc.

Such changes and modifications are to be understood as being within the scope of the present invention as defined by the appended claims.

What is claimed is:

1. An evaporator unit comprising:

an ejector having a nozzle for decompressing refrigerant, and a refrigerant suction port, from which refrigerant is drawn by a high-speed flow of refrigerant jetted from the nozzle;

an upwind side heat exchanger located at an upwind side of air flow for exchanging heat with refrigerant, wherein the upwind side heat exchanger evaporates a discharge side refrigerant flowing out of an outlet of the ejector; and a downwind side heat exchanger located at a downwind side of the upwind side heat exchanger in the air flow, wherein at least a part of the downwind side heat exchanger evaporates a suction side refrigerant to be drawn into the refrigerant suction port of the ejector, the upwind side heat exchanger has a refrigerant superheat area, which is offset from a refrigerant superheat area of the downwind side heat exchanger in a direction perpendicular to the air flow, the upwind side heat exchanger has an upwind tank extending in a tank longitudinal direction and an upwind heat exchanging portion, and the downwind side heat exchanger has a downwind tank extending in the tank longitudinal direction adjacent to the upwind tank and a downwind heat exchanging portion; and the ejector is arranged in the downwind tank to extend along the tank longitudinal direction.

2. The evaporator unit according to claim 1, wherein:

the refrigerant superheat area of the upwind side heat exchanger is offset from the refrigerant superheat area of the downwind side heat exchanger to prevent an overlap between the superheat areas in the air flow.

3. The evaporator unit according to claim 1, wherein:

the upwind side heat exchanger and the downwind side heat exchanger are located such that a flowing direction of the discharge side refrigerant in the upwind side heat exchanger is opposite to a flowing direction of the suction side refrigerant in the downwind side heat exchanger in the air flow.

4. The evaporator unit according to claim 1, wherein:

the discharge side refrigerant flows while changing its flowing direction once or more times in the downwind side heat exchanging portion.

5. The evaporator unit according to claim 1, wherein:

the suction side refrigerant flows while changing its flowing direction once or more times in the downwind heat exchanging portion.

6. The evaporator unit according to claim 1, wherein:

the downwind heat exchanging portion includes a first heat exchanging portion, in which the discharge side refrigerant flows, and a second heat exchanging portion in which the suction side refrigerant flows.

7. The evaporator unit according to claim 6, wherein:

the downwind side heat exchanger includes a plurality of tubes extending in a tube longitudinal direction, the downwind tank including first and second header tanks located at both end sides of the tubes to extend in a direction perpendicular to the tube longitudinal direction, and a separator member which is located in at least one of the first and second header tanks to separate the downwind side heat exchanger into the first heat exchanging portion and the second heat exchanging portion.

8. The evaporator unit according to claim 6, wherein:

the first heat exchanging portion of the downwind side heat exchanger communicates with the upwind side heat exchanger such that the discharge side refrigerant flows through the first heat exchanging portion of the downwind side heat exchanger and the upwind side heat exchanger.

9. The evaporator unit according to claim 6, wherein:

the second heat exchanging portion of the downwind side heat exchanger has an occupancy rate to the downwind side heat exchanger; and the occupancy rate is in a range between 30% and 75%.

10. An ejector type refrigeration cycle according to claim 9, the cycle comprising:

a compressor for compressing refrigerant;

a radiator for radiating heat of a high-temperature and high-pressure refrigerant flowing from the compressor; and an evaporator unit which includes the ejector, the upwind side heat exchanger and the downwind side heat exchanger; wherein the evaporator unit is coupled with the compressor and the radiator, the evaporator unit has a flowing ratio of a flowing amount of the suction side refrigerant to a flowing amount of refrigerant discharged from the compressor, and the flowing ratio is in a range between 0.3 and 0.7.

11. An ejector type refrigeration cycle, comprising:

a compressor for compressing refrigerant;

a radiator for radiating heat of a high-temperature and high-pressure refrigerant flowing from the compressor; and an evaporator unit which includes an ejector having a nozzle for decompressing refrigerant, and a refrigerant suction port from which refrigerant is drawn by a high-speed flow of refrigerant jetted from the nozzle, an upwind side heat exchanger located at an upwind side of air flow for exchanging heat with refrigerant, wherein the upwind side heat exchanger evaporates a discharge side refrigerant flowing out of an outlet of the ejector, and a downwind side heat exchanger located at a downwind side of the upwind side heat exchanger in the air flow, wherein at least a part of the downwind side heat exchanger evaporates a suction side refrigerant to be drawn into the refrigerant suction port of the ejector, the downwind side heat exchanger includes a first heat exchanging portion for evaporating the discharge side refrigerant, and a second heat exchanging portion for evaporating the suction side refrigerant, the evaporator unit has an occupancy rate of the second heat exchanging portion to the downwind side heat exchanger, the evaporator unit has a flowing ratio of a flowing amount of the suction side refrigerant to a flowing amount of refrigerant discharged from the compressor, and the flowing ratio is set in accordance with the occupancy rate.

12. The evaporator unit according to claim 11, wherein:

the downwind side heat exchanger includes a plurality of tubes extending in a tube longitudinal direction, first and second header tanks located at both end sides of the tubes to extend in a direction perpendicular to the tube longitudinal direction, and a separator member which is located in at least one of the first and second header tanks to separate the downwind side heat exchanger into the first heat exchanging portion and the second heat exchanging portion.

13. The evaporator unit according to claim 1, wherein:

the downwind tank has a refrigerant inlet from which the suction side refrigerant to be drawn into the refrigerant suction port flows;

the upwind tank has a refrigerant outlet from which the refrigerant flows outside, the refrigerant outlet being located at the same side as the refrigerant inlet in the tank longitudinal direction;

the downwind side tank has therein a distribution tank space for distributing the refrigerant to the downwind heat exchanging portion, and a join tank space separate from the distribution tank space to join the refrigerant from the downwind heat exchanging portion;

the upwind tank has a join tank space that is located adjacent to the distribution tank space of the downstream side tank in the air flow and the refrigerant suction port of the ejector communicates with the join tank space of the downwind tank.

14. An evaporator unit comprising:

an ejector having a nozzle for decompressing refrigerant, and a refrigerant suction port, from which refrigerant is drawn by a high-speed flow of refrigerant jetted from the nozzle;

an upwind side heat exchanger located at an upwind side of air flow through the evaporator unit for exchanging heat with refrigerant, wherein the upwind side heat exchanger evaporates a discharge side refrigerant flowing out of an outlet of the ejector; and a downwind side heat exchanger located at a downwind side of the upwind side heat exchanger in the air flow, wherein at least a part of the downwind side heat exchanger evaporates a suction side refrigerant to be drawn into the refrigerant suction port of the ejector, the upwind side heat exchanger has a refrigerant superheat area, which is offset from a refrigerant superheat area of the downwind side heat exchanger in a direction perpendicular to the air flow, the upwind side heat exchanger has an upwind tank extending in a tank longitudinal direction and an upwind heat exchanging portion, and the downwind side heat exchanger has a downwind tank extending in the tank longitudinal direction adjacent to the upwind tank and a downwind heat exchanging portion;

the ejector is arranged in the downwind tank to extend along the tank longitudinal direction;

the downwind tank has therein a tank space in which the refrigerant suction port is directly open; and the upwind tank has therein a refrigerant outlet tank space communicating with a refrigerant outlet, the refrigerant outlet tank space is offset from the tank space of the downwind tank in the tank longitudinal direction.

15. The evaporator unit according to claim 14, wherein the downwind side heat exchanger includes a first heat exchanger that evaporates the discharge side refrigerant and a second heat exchanger that evaporates the suction side refrigerant.

16. The evaporator unit according to claim 15, wherein refrigerant flows directly from the first heat exchanger to the upwind side heat exchanger.

17. The evaporator unit according to claim 14, wherein refrigerant flows directly from the downwind side heat exchanger to the upwind side heat exchanger.

18. The evaporator unit according to claim 1, wherein the downwind side heat exchanger includes a first heat exchanger that evaporates the discharge side refrigerant and a second heat exchanger that evaporates the suction side refrigerant.

19. The evaporator unit according to claim 18, wherein refrigerant flows directly from the first heat exchanger to the upwind side heat exchanger.

20. The evaporator unit according to claim 1, wherein refrigerant flows directly from the downwind side heat exchanger to the upwind side heat exchanger.

* * * * *